US011136529B2

(12) United States Patent
Olson et al.

(10) Patent No.: US 11,136,529 B2
(45) Date of Patent: Oct. 5, 2021

(54) SOLID DETERGENT COMPOSITIONS AND METHODS OF ADJUSTING THE DISPENSE RATE OF SOLID DETERGENTS USING SOLID ANIONIC SURFACTANTS

(71) Applicant: Ecolab USA Inc., Saint Paul, MN (US)

(72) Inventors: Erik C. Olson, Saint Paul, MN (US); Chelsea Pettit, Saint Paul, MN (US); Matt Molinaro, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 97 days.

(21) Appl. No.: 15/697,890

(22) Filed: Sep. 7, 2017

(65) Prior Publication Data

US 2018/0066208 A1 Mar. 8, 2018

Related U.S. Application Data

(60) Provisional application No. 62/384,489, filed on Sep. 7, 2016.

(51) Int. Cl.

| | |
|---|---|
| ***C11D 17/00*** | (2006.01) |
| ***C11D 17/06*** | (2006.01) |
| ***C11D 1/02*** | (2006.01) |
| ***C11D 1/12*** | (2006.01) |
| ***C11D 3/10*** | (2006.01) |
| ***C11D 3/37*** | (2006.01) |
| ***C11D 1/14*** | (2006.01) |
| ***C11D 3/08*** | (2006.01) |
| ***C11D 3/30*** | (2006.01) |
| ***C11D 3/32*** | (2006.01) |
| ***C11D 13/18*** | (2006.01) |
| ***C11D 1/22*** | (2006.01) |
| ***C11D 3/48*** | (2006.01) |
| ***C11D 3/04*** | (2006.01) |

(52) U.S. Cl.

CPC ..... *C11D 1/143* (2013.01); *C11D 1/22* (2013.01); *C11D 3/044* (2013.01); *C11D 3/08* (2013.01); *C11D 3/10* (2013.01); *C11D 3/30* (2013.01); *C11D 3/323* (2013.01); *C11D 3/3749* (2013.01); *C11D 3/48* (2013.01); *C11D 13/18* (2013.01); *C11D 17/0052* (2013.01); *C11D 17/0065* (2013.01)

(58) Field of Classification Search

None

See application file for complete search history.

(56) References Cited

U.S. PATENT DOCUMENTS

| | | | | |
|---|---|---|---|---|
| 4,680,134 | A | 7/1987 | Heile et al. | |
| 5,062,962 | A | 11/1991 | Brown et al. | |
| 5,078,891 | A | 1/1992 | Sherwood et al. | |
| 5,147,555 | A | 9/1992 | Brown et al. | |
| 5,158,685 | A | 10/1992 | Freese | |
| 5,271,862 | A | 12/1993 | Freese | |
| 5,397,506 | A | 3/1995 | Groth et al. | |
| 5,409,062 | A | 4/1995 | Brown et al. | |
| 5,578,246 | A | 11/1996 | Beardwood | |
| 5,800,732 | A | 9/1998 | Coughlin et al. | |
| 5,994,288 | A | 11/1999 | Urfer et al. | |
| 6,124,250 | A | 9/2000 | Olson et al. | |
| 6,387,870 | B1 | 5/2002 | Klaers et al. | |
| 6,395,702 | B2 | 5/2002 | Scepanski | |
| 6,440,926 | B1 | 8/2002 | Spadoni et al. | |
| 6,559,115 | B1 * | 5/2003 | Tcheou | C11D 1/22 510/294 |
| 6,585,933 | B1 | 7/2003 | Ehrhardt et al. | |
| 6,685,840 | B2 | 2/2004 | Hatch | |
| 6,908,895 | B2 | 6/2005 | Bakker et al. | |
| 7,153,820 | B2 | 12/2006 | Olson et al. | |
| 7,199,096 | B1 * | 4/2007 | Weuthen | C11D 1/662 510/224 |
| 7,863,237 | B2 | 1/2011 | Rigley et al. | |
| 8,697,625 | B2 | 4/2014 | Bartelme et al. | |
| 8,889,048 | B2 | 11/2014 | Stolte et al. | |
| 2002/0198134 | A1 | 12/2002 | Bakker et al. | |
| 2003/0162685 | A1 * | 8/2003 | Man | C11D 3/046 510/445 |
| 2004/0014630 | A1 * | 1/2004 | Lopez | C11D 3/2079 510/445 |
| 2004/0167054 | A1 * | 8/2004 | Tcheou | C11D 1/62 510/445 |

(Continued)

FOREIGN PATENT DOCUMENTS

| | | | |
|---|---|---|---|
| CN | 101827925 | A | 9/2010 |
| JP | 8283796 | A | 10/1996 |

(Continued)

OTHER PUBLICATIONS

Ecolab USA Inc., PCT/US2017/050478 filed Sep. 7, 2017, "Notification of Transmittal of the International Searching Report and the Written Opinion of the International Searching Authority, or the Declaration", dated Nov. 14, 2017.

Hibare, et al., "Behaviour of Soft Granules Under Compression: Effect of Reactive and Non-Reactive Nature of the Binder on Granule Properties," Powder Technology, 210 (2011), pp. 241-247, available online Mar. 31, 2011.

(Continued)

*Primary Examiner* — Lorna M Douyon

(74) *Attorney, Agent, or Firm* — McKee, Voorhees & Sease, PLC

(57) ABSTRACT

A method of adjusting dispense rate of a solid detergent block of a detergent composition is described here. A solid detergent block is produced from this method may have a predetermined dispense rate or a comparable dispense rate as a solid detergent block produced by extruding method. A process for producing a solid detergent block and a solid detergent composition are also disclosed.

12 Claims, 4 Drawing Sheets

(56) References Cited

U.S. PATENT DOCUMENTS

| | | | | |
|---|---|---|---|---|
| 2005/0101506 | A1 | 5/2005 | Lentsch et al. | |
| 2005/0113278 | A1 | 5/2005 | Stolte et al. | |
| 2006/0025325 | A1 | 2/2006 | Ryther | |
| 2007/0249513 | A1 | 10/2007 | Mort et al. | |
| 2008/0280806 | A1* | 11/2008 | Bartelme | C11D 1/04 510/446 |
| 2009/0042756 | A1 | 2/2009 | Muzik et al. | |
| 2009/0105111 | A1 | 4/2009 | Stolte et al. | |
| 2009/0176688 | A1 | 7/2009 | Tjelta et al. | |
| 2010/0032394 | A1 | 2/2010 | Wang | |
| 2010/0093597 | A1 | 4/2010 | Tadrowski | |
| 2011/0112003 | A1* | 5/2011 | Mohs | C11D 3/044 510/218 |
| 2011/0124547 | A1 | 5/2011 | Tjelta et al. | |
| 2013/0324455 | A1* | 12/2013 | Blattner | C11D 3/3707 510/438 |
| 2014/0219994 | A1 | 8/2014 | Liu et al. | |
| 2014/0227790 | A1 | 8/2014 | Smith et al. | |
| 2014/0323385 | A1 | 10/2014 | Bartelme et al. | |
| 2015/0133357 | A1* | 5/2015 | Dotzauer | C11D 1/66 510/218 |
| 2015/0252296 | A1 | 9/2015 | Roerdink Lander et al. | |
| 2016/0002576 | A1 | 1/2016 | Jones et al. | |

FOREIGN PATENT DOCUMENTS

| | | | |
|---|---|---|---|
| JP | 2007512420 | A | 5/2007 |
| JP | 2011500913 | A | 1/2011 |
| WO | 199401526 | A1 | 1/1994 |
| WO | 0040691 | A1 | 7/2000 |
| WO | 2000066810 | A1 | 11/2000 |
| WO | 2001094510 | A1 | 12/2001 |

OTHER PUBLICATIONS

Germaná, et al., "LAS Acid Reactive Binder: Wettability and Adhesion Behaviour in Detergent Granulation," Powder Technology 189 (2009) pp. 385-393, available online Apr. 16, 2008.

Dong, et al., "Property Investigation of Dodecyl Benzyl Sulfobetaine as Phosphate-Free Detergent Builder," China Surfactant Detergent & Cosmetics, vol. 44, No. 10, ISSN:1001-1803, published Oct. 3, 2014.

Wei-Li, et al., "Study on Formulation and Process of Low-Density Concentrated Laundry Powder," Detergent & Cosmetics, vol. 33, No. 4, pp. 27-31, ISSN:1006-7264, published Apr. 30, 2010.

Xiao-Ying, et al., "Composition Analysis of Powder Detergents," Detergents & Cosmetics, vol. 38, pp. 45-48 and 52, ISSN:1006-7264, published Oct. 31, 2015.

* cited by examiner

SOLID DETERGENT COMPOSITIONS AND METHODS OF ADJUSTING THE DISPENSE RATE OF SOLID DETERGENTS USING SOLID ANIONIC SURFACTANTS

CROSS-REFERENCE TO RELATED APPLICATIONS

This application claims priority to U.S. Provisional Application Ser. No. 62/384,489, filed Sep. 7, 2016, titled Method of Adjusting the Dispense Rate of Solid Detergents Using Anionic Surfactants, which is herein incorporated by reference in its entirety.

FIELD OF THE INVENTION

The invention relates to a method of adjusting dispense rate of a solid detergent composition and a pressed solid detergent composition and their methods of use. In particular, pressed solid detergent block compositions are formed by pressing a mixture comprising a first solid comprising an alkaline source and a second solid comprising an anionic surfactant, wherein the pressed solid detergent block composition has a desired dispense rate achieved through the formulation comprising select types and/or amounts of anionic surfactants and/or additional materials. The invention also relates to a method of adjusting a dispense rate of a solid detergent block composition, in particular a pressed solid detergent block composition, by using different types and/or amounts of anionic surfactants and/or additional materials.

BACKGROUND OF THE INVENTION

Aqueous cleaning compositions have commonly been used in applications including hospital, household, institutional and industrial services, hand and body soaps, laundry soaps, ware washing and housekeeping surfaces. Typically, these cleaning materials are made by diluting liquid or gelled materials to form a use solution. Many such solutions have had some success in the past, however, a substantial need in this art exists to manufacture an easily used concentrate having minimal water and a high actives concentration, excellent soil, e.g. grease, removal properties and controlled foaming. Many prior art materials even in a concentrate form contain substantial amounts of water which is difficult to manufacture, transport and sell. The materials also may have some soil removal properties but improving grease removal and hard surface cleaners is a continuing need or requirement.

Solid detergent blocks have unique advantages over the conventional liquids, granules, or pellet forms of detergents, including improved handling, enhanced safety, and elimination of component segregation during transportation and storage, and increased concentrations of active components within the composition. Because of these advantages, solid detergent blocks are widely used, especially by commercial and institutional entities that routinely use large quantities of cleaning materials.

Various compositions and methods to produce solid detergent blocks are disclosed. Stolte et. al., U.S. Pat. No. 6,387,870, which is incorporated by reference herein, disclosed one such composition and discussed the prior art for similar solid detergent blocks. Regardless of the methods of making solid detergent blocks, there is a need to provide upon dispensing specific use dilutions of the detergent composition. Therefore, it is critical to provide consistent dispensing rates of the solid detergent blocks without requiring manipulation and/or modifications to a dispenser setting.

Accordingly, it is an objective to develop a method to adjust a dispense rate of a pressed solid detergent block composition by using different amount or types of anionic surfactants and/or additional materials in pressed solid detergent compositions.

Another object is to develop a pressed solid detergent composition, so a pressed solid detergent block can be not only produced by a pressing process but also has a predetermined dispense rate to take advantage of the existing or known dispensing equipment.

Other objects, advantages and features will become apparent from the following specification taken in conjunction with the accompanying examples, figures, and drawings.

BRIEF SUMMARY OF THE INVENTION

An advantage of the methods, processes and compositions is that a solid detergent composition for a solid block or other forms can be modified to have a specific predetermined dispense rate for various dispensing and/or cleaning requirements using a given dispensing equipment.

It is surprisingly discovered that mixing a solid anionic surfactant and a solid detergent composition, preferably a pressed solid detergent composition, can produce solid blocks with various dispense rates which can be modified by using different types and/or amounts of anionic surfactants and/or additional materials in the compositions. In an aspect, the adjusting of the dispense rate provides essentially same dispense rate as an existing solid block with an essentially similar composition, dimension and shape, measured by the same procedure, condition, and equipment.

In one aspect, a method of adjusting dispense rate of an existing solid detergent composition comprises: mixing an anionic surfactant solid and/or other materials and a solid detergent composition comprising an alkaline source to obtain a solid mixture, and pressing the mixture to form a block. In an aspect, the adjusting of the dispense rate provides essentially same dispense rate as an existing solid detergent composition with an essentially similar composition, dimension and shape, measured by the same procedure, conditions, and equipment. In yet another aspect, a pressed solid detergent block is produced by a process, the process comprising: (a) mixing a first solid comprising an anionic surfactant, and a second solid comprising an alkaline source to obtain a mixture, and (b) pressing the mixture in a mold to form a block, wherein the alkaline source comprises one or more alkaline compounds.

In yet another aspect, a pressed solid detergent block composition comprises: (a) a first solid comprising an anionic surfactant, and (b) a second solid comprising an alkaline source, wherein the alkaline source comprises one or more alkaline compounds, the first solid and the second solid are mixed and pressed to produce a solid block.

In another aspect, a method of cleaning, sanitizing and/or bleaching comprises contacting a surface or object in need of cleaning, sanitizing and/or bleaching with a use solution of the block produced from the method, process or composition disclosed herein.

While multiple embodiments are disclosed, still other embodiments of the present invention will become apparent to those skilled in the art from the following detailed description, which shows and describes illustrative embodiments of the invention.

Accordingly, the examples, figures, drawings, and detailed description are to be regarded as illustrative in nature and not restrictive.

Figure 1:
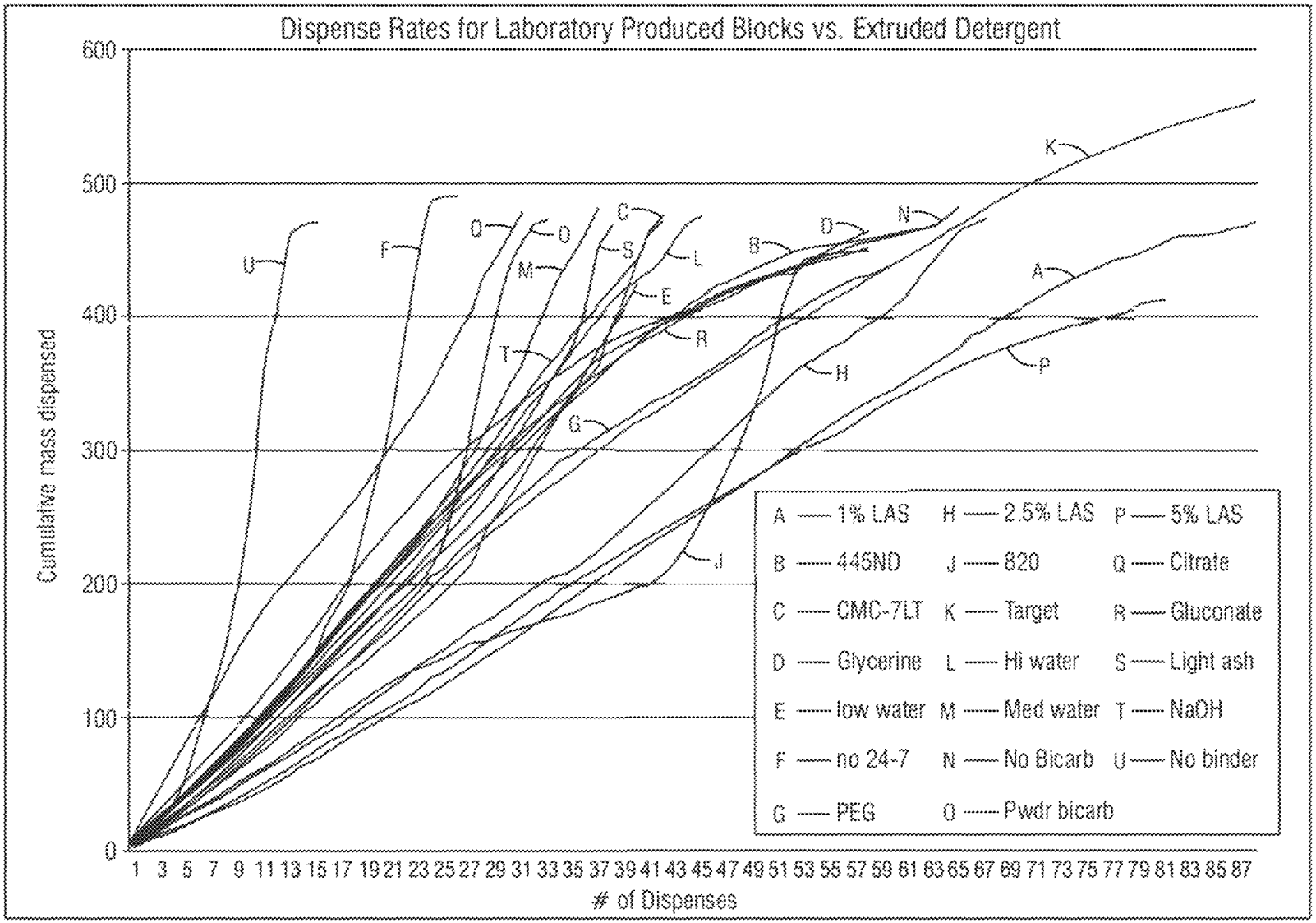
FIG. 1 shows the dispense rate comparing solid detergent block composition evaluated herein.

Various embodiments of the present invention will be described in detail with reference to the examples, figures, and drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

A method for adjusting a dispense rate of a pressed solid detergent block is provided, so the pressed solid detergent block can deliver a predetermined amount of cleaning, sanitizing, and/or bleaching agent for various purposes in a given or existing dispensing equipment. The method disclosed here has many advantages and useful applications. For example, the method can produce a solid detergent block that has a dispense rate equivalent to or comparable to a solid detergent block produced by a distinct solidification method (e.g. pressing, casting, extruding, and the like). Solid detergent blocks with different dispense rates can be produced with the disclosed method and used in the same dispense equipment for different detergent concentrations, thus different applications.

A process to produce pressed solid detergent blocks with substantially similar cleaning performance, but predetermined or desired dispense rates is also provided. The produced solid detergent blocks can be used in a similar or identical dispenser to an existing product, yet to deliver different detergent concentration for different applications. The process provides a method for modifying the dispense rate of a pressed solid detergent block.

A pressed solid detergent composition that can be used to produce a solid detergent block with not only a predetermined or desired dispense rate, but also substantially similar cleaning performance as an existing solid block composition is also provided.

The embodiments of this invention are not limited to particular compositions, processes and methods of use, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, aryl carbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

Alkenyl groups or alkenes are straight chain, branched, or cyclic alkyl groups having two to about 30 carbon atoms, and further including at least one double bond. In some embodiments, alkenyl groups have from 2 to about 20 carbon, or typically, from 2 to 10 carbone atoms. Alkenyl groups may be substituted or unsubstituted. Alkenyl groups may be substituted similarly to alkyl groups.

As used herein, the terms "alkylene", cycloalkylene", alkynylene, and alkenylene", alone or as part of another substituent, refer to a divalent radical derived from an alkyl, cycloalkyl, or alkenyl group, respectively, as exemplified by —$CH_2CH_2CH_2$—. For alkylene, cycloalkylene, alkynylene, and alkenylene groups, no orientation of the linking group is implied.

As used herein, "aryl" or "aromatic" groups are cyclic aromatic hydrocarbons that do not contains heteroatoms. Aryl groups include monocyclic, bicyclic, and polycyclic ring systems. Thus, aryl groups include, but are not limited to, phenyl, azulenyl, heptalenyl, biphenylenyl, indacenyl, florenyl, phenanthrenyl, triphenylenyl, pyrenyl, naphthacenyl, chrysenyl, biphenyl, anthracenyl, indenyl, indanyl, pentalenyl, and naphthyl groups. In some embodiments, aryl groups contain 6-14 carbons, in others from 6 to 12 or 6-10 carbon atoms in the ring portions of the groups. The phrase "aryl groups" includes groups containing fused rings, such as fused aromatic-aliphatic ring systems. Aryl groups may be substituted or unsubstituted.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

As used herein, the term "cleaning" refers to perform, facilitate, or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the term "disinfectant" refers to an agent that kills all vegetative cells including most recognized pathogenic microorganisms, using the procedure described in *A.O.A.C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

An "existing solid detergent composition" as used herein refers to a detergent composition that includes all active detersive ingredients and optionally one or more of the additional functional ingredients, but without its water content or with a reduced or full water content, as compared to the solid detergent compositions having the adjusted dispense rates as modified according to the compositions and/or methods disclosed herein by using different types and/or amounts of anionic surfactants and/or additional materials in the compositions. All of the existing solid detergent compositions as used herein contain an alkaline source.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

As used herein, the phrase "food product" includes any food substance that might require treatment with an antimicrobial agent or composition and that is edible with or without further preparation. Food products include meat (e.g. red meat and pork), seafood, poultry, produce (e.g., fruits and vegetables), eggs, living eggs, egg products, ready to eat food, wheat, seeds, roots, tubers, leaves, stems, corns, flowers, sprouts, seasonings, or a combination thereof. The term "produce" refers to food products such as fruits and vegetables and plants or plant-derived materials that are typically sold uncooked and, often, unpackaged, and that can sometimes be eaten raw.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the phrase "health care surface" refers to a surface of an instrument, a device, a cart, a cage, furniture, a structure, a building, or the like that is employed as part of a health care activity. Examples of health care surfaces include surfaces of medical or dental instruments, of medical or dental devices, of electronic apparatus employed for monitoring patient health, and of floors, walls, or fixtures of structures in which health care occurs. Health care surfaces are found in hospital, surgical, infirmity, birthing, mortuary, and clinical diagnosis rooms. These surfaces can be those typified as "hard surfaces" (such as walls, floors, bed-pans, etc.), or fabric surfaces, e.g., knit, woven, and non-woven surfaces (such as surgical garments, draperies, bed linens, bandages, etc.), or patient-care equipment (such as respirators, diagnostic equipment, shunts, body scopes, wheel chairs, beds, etc.), or surgical and diagnostic equipment. Health care surfaces include articles and surfaces employed in animal health care.

As used herein, the term "instrument" refers to the various medical or dental instruments or devices that can benefit from cleaning with a composition according to the present invention.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

As used herein, the phrases "medical instrument," "dental instrument," "medical device," "dental device," "medical equipment," or "dental equipment" refer to instruments, devices, tools, appliances, apparatus, and equipment used in medicine or dentistry. Such instruments, devices, and equipment can be cold sterilized, soaked or washed and then heat sterilized, or otherwise benefit from cleaning in a composition of the present invention. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, scopes (e.g., endoscopes, stethoscopes, and arthoscopes) and related equipment, and the like, or combinations thereof.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

For the purpose of this application, successful microbial reduction is achieved when the microbial populations are reduced by at least about 50%, or by significantly more than is achieved by a wash with water. Larger reductions in microbial population provide greater levels of protection.

As used herein, the term "sanitizer" refers to an agent that reduces the number of bacterial contaminants to safe levels as judged by public health requirements. In an embodiment, sanitizers for use in this invention will provide at least a 3-log reduction and more preferably a 5-log order reduction. These reductions can be evaluated using a procedure set out in *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2). According to this reference a sanitizer should provide a 99.999% reduction (5-log order reduction) within 30 seconds at room temperature, 25±2° C., against several test organisms. Criteria for sanitizers and disinfectants may be different, depending on applications and regions.

As used herein, the term "soil" or "stain" refers to a non-polar oily substance which may or may not contain particulate matter such as mineral clays, sand, natural mineral matter, carbon black, graphite, kaolin, environmental dust, etc.

As used in this invention, the term "sporicide" refers to a physical or chemical agent or process having the ability to cause greater than a 90% reduction (1-log order reduction) in the population of spores of *Bacillus cereus* or *Bacillus subtilis* within 10 seconds at 60° C. In certain embodiments, the sporicidal compositions of the invention provide greater than a 99% reduction (2-log order reduction), greater than a 99.99% reduction (4-log order reduction), or greater than a 99.999% reduction (5-log order reduction) in such population within 10 seconds at 60° C.

Differentiation of antimicrobial "-cidal" or "-static" activity, the definitions which describe the degree of efficacy, and the official laboratory protocols for measuring this efficacy are considerations for understanding the relevance of antimicrobial agents and compositions. Antimicrobial compositions can affect two kinds of microbial cell damage. The first is a lethal, irreversible action resulting in complete microbial cell destruction or incapacitation. The second type of cell damage is reversible, such that if the organism is rendered free of the agent, it can again multiply. The former is termed microbiocidal and the later, microbistatic. A sanitizer and a disinfectant are, by definition, agents which provide antimicrobial or microbiocidal activity. In contrast, a preservative is generally described as an inhibitor or microbistatic composition As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The terms "vehicle" or "car" as used herein, refer to any transportation conveyance including without limitation, automobiles, trucks, sport utility vehicles, buses, trucks, motorcycles, monorails, diesel locomotives, passenger coaches, small single engine private airplanes, corporate jet aircraft, commercial airline equipment, etc.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polypropylene polymers (PP), polycarbonate polymers (PC), melamine formaldehyde resins or melamine resin (melamine), acrilonitrile-butadiene-styrene polymers (ABS), and polysulfone polymers (PS). Other exemplary plastics that can be cleaned using the compounds and compositions of the invention include polyethylene terephthalate (PET) polystyrene polyamide.

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like. Waters also include domestic and recreational waters such as pools, spas, recreational flumes and water slides, fountains, and the like.

As used herein, the phrase "water soluble" means that the material is soluble in water in the present composition. In general, the material should be soluble at 25° C. at a concentration of about 0.1 wt. % of the water, alternatively at about 1 wt. %, alternatively at about 5 wt. %, and alternatively at about 15 wt. %.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, processes, and compositions of the present invention may comprise, consist essentially of, or consist of the components and ingredients of the present invention as well as other ingredients described herein. As used herein, "consisting essentially of" means that the methods, processes and compositions may include additional steps, components or ingredients, but only if the additional steps, components or ingredients do not materially alter the basic and novel characteristics of the claimed methods, processes and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Solid Detergents

As used herein, the term "solid" refers to a state of matter known to those of skill in the art. A solid may be of crystalline, amorphous form, or a mixture thereof. A solid composition can include a single compound or a mixture of compounds. A solid may be a mixture of two or more different solids. A solid may be aggregates of particles, each of which has a size of a few, a few tens, a few hundreds of micrometers or nanometers. A solid may be a powder of one or more compounds.

As used herein, a solid detergent, solid formulation or solid cleaning composition refers to a detergent or cleaning composition in the form of a solid such as a powder, a flake, a granule, a pellet, a tablet, a lozenge, a puck, a briquette, a brick, a solid block, or another solid form known to those of skill in the art. It should be understood that the term "solid detergent" refers to the state of the detergent composition under the expected conditions of storage and use of the solid detergent composition. In general, it is expected that the detergent composition will remain a solid when provided at a temperature of a room temperature up to about 120° F.

A solid detergent composition can be provided as a pressed solid block, a cast solid block, an extruded pellet or block, or a tablet so that one or a plurality of the solids will be available in a package having a size of between about 1 grams and about 11,000 grams.

A solid detergent composition may be provided in the form of a unit dose. A unit dose refers to a solid detergent composition unit sized so that the entire unit is used during a single washing cycle. When the solid detergent composition is provided as a unit dose, it is preferably provided as a pressed solid, a cast solid, an extruded pellet, or a tablet having a size of between about 1 gram and about 50 grams. Alternatively, a pressed solid, a cast solid, an extruded pellet, or a tablet may have a size of between 50 grams up through 250 grams. An extruded, cast, or pressed solid may have a weight of about 100 grams or greater. According to embodiments of the invention, the solid detergent composition is preferably a pressed solid.

A solid detergent composition may also be provided in the form of a multiple use solid, such as a block or pellet, and can be repeatedly used to generate an aqueous detergent composition, e.g., use solution, for multiple washing cycles.

Typically, the solid detergent composition as disclosed herein dissolves quickly and completely upon contact with aqueous solution into a stable use solution. In some aspects of the invention, the amount and type of anionic surfactants employed in the solid detergent composition provides a desired dissolution rate for a particular dispense rate. A stable use solution does not contain any solids upon visual inspection.

Pressed solid detergent blocks are made suitable to provide stability such that reactive components in the compositions do not react with each other until a point of dilution and/or use. In some aspects, the order of introducing the components to form the solid are non-limiting as there is minimal and/or no water introduced into the solid compositions. However, in some aspects, pressed solid detergent blocks are made by using a binding system to minimize any damage to the coated granules which may be employed.

Beneficially, a pressing process to make the pressed solid detergent blocks prevents the reaction or mix of the components. In an aspect of the invention, the different components of a solid detergent composition remain unreacted or unmixed until a point of use, e.g. dilution.

In a pressed solid process, a flowable solid, such as granular solids or other particulate solids including binding agents are combined under pressure. In a pressed solid process, flowable solids of the compositions are placed into a form (e.g., a mold or container gently pressed the flowable solid in the form to produce the solid cleaning blocks or other formats.

The method can further include a curing step to produce the solid cleaning blocks. As referred to herein, an uncured composition including the flowable solid is compressed to provide sufficient surface contact between particles making up the flowable solid that the uncured composition will solidify into a stable solid cleaning composition. A sufficient quantity of particles (e.g. granules) in contact with one another provides binding of particles to one another effective for making a stable solid composition. Inclusion of a curing step may include allowing the pressed solid to solidify for a period of time, such as a few hours, or about 1 day (or longer). In additional aspects, the methods could include vibrating the flowable solid in the form or mold, such as the methods disclosed in U.S. Pat. No. 8,889,048, which is herein incorporated by reference in its entirety.

The use of pressed solids provides numerous benefits over conventional solid blocks or tablets by a tablet press requiring high pressure in, or casting requiring the melting of a composition consuming significant amounts of energy, and/or by extrusion requiring expensive equipment and advanced technical know-how. Pressed solids overcome such various limitations of other solid blocks, therefore there is a need for making new pressed solid cleaning compositions. Moreover, pressed solid blocks have more consistent and attractive appearance than extruded ones, therefore pressed solid detergent blocks can form solid blocks of distinct shapes for identification and control of use. They can retain its shape under conditions in which the blocks may be stored or handled. In general, it is expected that the detergent composition will remain a solid when provided at a temperature of up to about 120° F.

In some situations, the methods of making pressed blocks reduce or eliminate water from the composition. Preferably, the compositions are formed using components in an anhydrous form. In some other situations, compositions have a water content of less than about 10% by weight, less than about 5% by weight, less than about 1% by weight, less than about 0.1% by weight, less than about 0.05% by weight, and most preferably free of water (e.g. dried). In an aspect, the dried composition may be in the form of granules. On contrast, cast or extruded solid detergent blocks can often have from about 20 to about 40 wt-% water. Therefore, pressed solid blocks are preferred due to the removal or reduction of water from the compositions and some of the alkaline source are not employed as a solidification mechanism.

The particulate components of the invention can be in the form of granules and/or flakes, but is preferably presented in the form of regular small granules. Thereafter, the granules are used to form solid detergent blocks. The solidification process may last from a few seconds to several hours, depending on factors including, but not limited to the size of the formed or cast composition, the ingredients of the composition, and the temperature of the composition.

The solid detergent compositions may be formed using a batch or continuous mixing system. To make extruded blocks, powders and liquids of a detergent composition are blended to form a mixture, then the blended mixture is pressed through a mold to form a product, then the product hardens with time to an extruded solid block. A single- or twin-screw extruder is used to combine and mix one or more cleaning agents at high shear to form a homogeneous mixture to make extruded blocks. To make pressed solid blocks, solid powders and/or other liquid ingredients of a detergent composition are just mixed to form a blended power, then the blended power is poured into a mold and pressed into a solid detergent block. Generally, a solid detergent block processed according to the method of the invention is substantially homogeneous with regard to the distribution of ingredients throughout its mass and is dimensionally stable.

In some embodiments, the solid detergent composition of the present disclosure is provided as a pressed solid block having a mass of between about 5 grams and 10 kilograms. In certain embodiments, a pressed solid detergent block has a mass between about 1 and about 10 kilograms. In further embodiments, a block of the solid detergent composition has a mass of between about 5 kilograms and about 8 kilograms. In other embodiments, a block of the solid detergent composition has a mass of between about 5 grams and about 1 kilogram, or between about 5 grams and about 500 grams.

Dispense Rates of a Solid Detergent Block

The term "dispense rate" as used herein, refers to mass loss or chemistry loss in numerical quantity that a block can incur, when the block is placed properly in dispensing unit, such an Apex Dispenser manufactured by Ecolab, Inc. and subjected to water contact through the dispenser's mechanism for a certain period of time. This period of time is referred as "dispense period", during which water with a certain temperature and pressure makes continuous and steady contact with the block on one of its surfaces and dissolve away the components of the block into water, e.g., turning into a use solution for cleaning and sanitizing applications. A variety of dispensers are suitable for dispensing the solid detergent blocks disclosed herein. A dispenser uses a block of a specific dimension and shape and can be configured to deliver water of a certain temperature and pressure. The range for water temperature is typically from about 50° F. to about 160° F., and the range for water pressure from about 20 psi to about 100 psi; preferably with temperatures about 90° F. to about 140° F. and water pressures from about 20 psi to about 60 psi.

In some aspects, a solid detergent block can have a dispense rate of from about 20 to about 120 g/per cycle, wherein the dispense rate is measured by a spray type dispenser using a 60 second dispense period, and water with a pressure of from about 20 psi to about 50 psi and a temperature of from 90° F. to about 140° F., and the solid block with a dimension and shape designed for the dispenser.

In other aspects, a solid detergent block can have a dispense rate of from about 30 to about 75 g/per cycle, wherein the dispense rate is measured by a spray type dispenser using a 60 second dispense period, and water with a pressure of about 20 psi and a temperature of from 90° F. to about 140° F., and the solid block with a dimension and shape designed for the dispenser.

In still other aspects, a solid detergent block can have a dispense rate of from about 20 to about 60 g/per cycle, wherein the dispense rate is measured by a spray type of dispenser using a 60 second dispense period, and water with a pressure of from about 20 psi to about 50 psi and a temperature of about 90° F., and the solid block with a dimension and shape designed for the dispenser.

In many aspects of everyday use, a user pushes a dispense button on the dispenser to activate water delivery to get the use solution. The amount of the use solution is determined by the time when the dispense button is being pushed. As the components of a solid block is dissolved into water whenever the dispense button is pushed, the solid block becomes smaller and smaller. When a solid block is completely consumed, a new solid block is placed into the dispenser. In some cases, one or more new solid blocks can be added before the existing block is consumed to ensure product availability.

When a dispense rate as used herein is determined, the dispense period in some embodiments is usually 60 seconds or 90 seconds, followed by a 90 second no dispense period. The combination of a dispense period and the subsequent no dispense period is referred to a "dispense cycle." As one skilled in the art appreciates, a dispense cycle varies for a particular application of use of the solid detergent block, e.g. warewashing, laundry, etc. During the determination of the dispense rate of a block, the mass dispensed after each cycle was monitored using a load cell. A load cell weighs the block after each dispense cycle, so the mass dispensed in each cycle is obtained from the weight difference between dispense cycles. This procedure is then repeated until the block is consumed or nearly consumed. The raw dispensing data is converted into a mean cumulative mass over duplicated measurements for multiple blocks (e.g. three or more identical blocks). The cumulative mass is then plotted against the number of dispense cycles and fit to a linear line using a standard procedure in a statistics software tool (such as Minitab 17 available from Minitab, Inc.).

When a dispenser is used to determine the dispense rate of a block, water, through a nozzle and dispense plate, with a certain temperature and pressure, hits the bottom surface of a pressed solid detergent block to dissolve the components of the block into a use solution. In exemplary applications of use of the solid detergent composition, water at a temperature of at least 90° F., 115° F., or 140° F. may be used. A pressure of at least 20 psi, 35 psi, or 50 psi for water may also be used, respectively. Various types of water can be used. In some aspects city or municipal water with 0, 5, 17, or higher grains per gallon (gpg) is employed.

According to an embodiment, the dispense rate of a solid detergent block is impacted by the composition and manner of making the solid detergent composition. But the composition and way of making do not determine a solid block's dispense rate exclusively. The dispenser's construct and working mechanism, water quality, water temperature, water pressure, and other factors also affect the block's dispense rate. Given the same dispenser, delivery mechanism, and water property, the dispense rate of a block is also affected by its dimension and shape, which also determine how the block's surface comes to make contact with water delivered by the dispenser. In other words, using dispense rates used here to compare a block's own properties with another block, not only the same dispenser, test procedure, water, but also the same dimension and shape of blocks should be used.

As one skilled in the art will ascertain, a dispenser configured for an existing solid detergent composition in one solid form may not provide the equivalent dispense range for a new pressed solid block without at least making some adjustment, if the pressed solid block does not match the existing block in term of dispense rate. The cost for getting a new dispenser or adjusting the existing dispenser, in order to replace an existing block with a pressed one, could affect a user's decision to switch blocks. Beneficially, the methods, processes, and compositions disclosed herein allow for formulation changes to adjust the dispense rate of a new solid detergent block to be equivalent to a predetermined or desired dispense rate.

Alternatively, a way to control dispense rate of a block through its composition, in a given dispenser, also makes economic sense. The identical or existing dispenser can be used for different purposes just by changing the blocks it uses. Given a dispenser, the concentration of a user solution is affected by a block's dispense rate.

In one aspect, disclosed herein is a method to adjust the dispense rate of an existing solid detergent block made from an existing composition, the method comprising: (a) mixing a first solid comprising a solid anionic surfactant and a second solid comprising an alkaline source to obtain a solid mixture, and (b) pressing the solid mixture by a solid pressing process to form a solid block, wherein the alkaline source comprises one or more alkaline compounds. The produced solid block has a different dispense rate, compared to the dispense rate of the solid block produced from an existing composition without the first solid. The second solid may be a complete solid detergent composition by itself.

In another aspect, disclosed herein is a pressed solid detergent block produced by a process, the process comprising (a) mixing a first solid comprising a solid anionic surfactant and a second solid comprising an alkaline source to form a solid mixture, and (b) pressing the solid mixture by a solid pressing process to form a solid block, wherein the alkaline source comprises one or more alkaline compounds and the solid block has a predetermined dispense rate.

In yet another aspect, disclosed herein is a solid detergent block composition comprising: (a) a first solid comprising a solid anionic surfactant, and (b) a second solid comprising an alkaline source, wherein the alkaline source comprises one or more alkaline compounds, the first solid and the second solid are mixed and pressed by a solid pressing process to produce a solid block.

Anionic Surfactants

The method of adjusting a dispense rate of a solid detergent block of a detergent composition, the process to produce a solid detergent block with a predetermined dispense rate, or the press solid composition according to this disclosure includes a first solid comprising an effective amount of one or more anionic surfactants.

Anionic surfactants are surface active substances in which the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

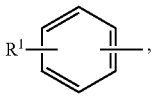

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

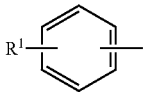

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Through research and experimentation, Applicants surprisingly discover that adding a solid anionic surfactant to an original pressed solid detergent composition can alter dispense rate of the pressed solid detergent block. Applicants also discover that the dispense rate of a pressed solid block can be either increased or decreased, depending on the amount and/or type of anionic surfactants used. More importantly, the dispense rate of a pressed solid detergent block may be adjusted to a pre-determined value by using different amount and/or type of anionic surfactants. Accordingly, a solid block with a predetermined dispense rate can be made by pressing a mixture of a solid comprising an anionic surfactant and another solid comprising alkali source and other detergent ingredients. Furthermore, the addition of anionic surfactant into a solid detergent composition does not negatively impact stability or performance of the original solid detergent composition.

In some embodiments, the pressed solid detergent block produced from the disclosed method, process or composition has about 0.1 wt % to about 25 wt %, 1 wt % to about 10 wt %, from about 3.5 wt % to about 4.5 wt %, about 20 wt %, about 15 wt %, about 10 wt %, about 5 wt %, about 4 wt %, about 3 wt %, about 2 wt %, about 1 wt %, about 0.5 wt %, or about 0.2 wt % of the solid anionic surfactant(s).

In some embodiments, this first solid of the disclosed method, process or composition contains one or more solid anionic surfactants only. In some other embodiments, the first solid contains about 99 wt-%, 95 wt-%, 80 wt-%, 70 wt-%, 60 wt-%, 50 wt-%, 40 wt-%, 30 wt-%, 20 wt-%, 10 wt-%, from about 90 wt-% to about 99% wt-%, from about 80 wt-% to about 89% wt-%, from about 70 wt-% to about 79% wt-%, from about 60 wt-% to about 69% wt-%, from about 50 wt-% to about 59% wt-%, from about 40 wt-% to about 49% wt-%, from about 30 wt-% to about 39% wt-%, from about 20 wt-% to about 29% wt-%, or from about 10 wt-% to about 19% wt-% of solid anionic surfactants.

In some embodiments, the anionic surfactant of the disclosed method, process or composition is an sulfonate, alkylsulfonate, alkylbenzenesulfonate, alkylarylsulfonate, olefin sulfonate, sulfonated fatty acid ester, sulfate, sulfated alcohol, sulfated alcohol ethoxylate, sulfated alkylphenol, alkylsulfate, sulfosuccinate, alkylether sulfate, phosphate ester, alkylphosphate ester, carboxylate, alkylcarboxylate, polyalkoxycarboxylate, alcohol ethoxylate carboxylate, nonylphenol ethoxylate carboxylate, or a mixture of two or more thereof. In some other embodiments, the anionic surfactant of the disclosed method, process, or composition is an alkylaryl-sulfonate, alpha-olefin sulfonate, fatty alcohol sulfate, alkyl sulfate, alkylbenzene sulfate, sulfosuccinate, sulfated alkylphnol, alkylether sulfate, or a mixture of two or more thereof.

In some embodiments, the anionic surfactant of the disclosed method, process or composition is one or more sulfates selected from a group consisting of an alpha olefin sulfate, linear alkylbenzene sulfate, and branched alkylbenzene sulfate. In some other embodiments, the anionic surfactant of the disclosed method, process, or composition is one or more sulfonate represented by formula $R^{10}SO_3X$ or $R^{11}C_6H_4SO_3X$, wherein $R^{10}$ is a $C_8$-$C_{20}$ alkyl or alkenyl group, or preferably $C_{14}$-$C_{16}$ alkyl or alkenyl group, $R^{11}$ is a $C_1$-$C_{15}$ alkyl or preferably $C_{10}$-$C_{13}$ alkyl, and X is $Na^+$, $K^+$, $Li^+$, or $NH_4^+$ or a mixture thereof. In yet some other embodiments, the anionic surfactant of the disclosed method, process, or composition is an olefin sulfonate represented by a formula $R^{12}CH{=}CH_2SO_3X$ or a mixture of two or more thereof, wherein $R^{12}$ is a $C_{10}$-$C_{16}$ alkyl or preferably $C_{12}$-$C_{14}$ alkyl and X is $Na^+$, $K^+$, $Li^+$, $NH_4^+$ or a mixture thereof. In some other embodiments, the anionic surfactant of the disclosed method, process, or composition is a linear alkyl benzene sulfonate represented by a formula $R^{13}C_6H_4SO_3X$ or a mixture of two or more thereof, wherein $R^{13}$ is a $C_3$-$C_{10}$ alkyl or preferably $C_4$-$C_7$ alkyl, or $C_{10}$-$C_{13}$ alkyl and X is $Na^+$, $K^+$, $NH_4^+$ or a mixture of two or more thereof.

Source of Alkalinity

The method, process or press solid composition according to the present invention includes a second solid comprising an effective amount of alkaline source. The alkaline source in turn comprises one or more alkaline compounds. In general, an effective amount of the alkaline source should be considered as an amount that provides a use solution having a pH of at least about 8. When the use solution has a pH of between about 8 and about 10, it can be considered mildly alkaline, and when the pH is greater than about 12, the use solution can be considered caustic. In general, it is desirable to provide the use solution as a mildly alkaline cleaning composition because it is considered to be safer than the caustic based use compositions. In some embodiments, a use solution of a solid block produced from the disclosed method, process, or composition here has a pH of above 8, above 9, above 10, above 11, or preferably from about 9 to about 11.5.

The alkaline source can include an alkali metal carbonate, an alkali metal hydroxide, alkaline metal silicate, or a mixture thereof. Suitable metal carbonates that can be used include, for example, sodium or potassium carbonate, bicarbonate, sesquicarbonate, or a mixture thereof. Suitable alkali metal hydroxides that can be used include, for example, sodium, lithium, or potassium hydroxide. Examples of useful alkaline metal silicates include sodium or potassium silicate (with $M_2O:SiO_2$ ratio of 2.4 to 5:1, M representing an alkali metal) or metasilicate. The alkaline source may also include a metal borate such as sodium or potassium borate, and the like.

The alkaline source may also include ethanolamines, urea sulfate, amines, amine salts, and quaternary ammonium. The simplest cationic amines, amine salts and quaternary ammonium compounds can be schematically drawn thus:

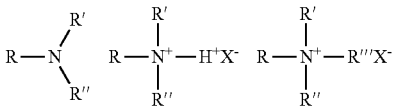

in which, R represents a long alkyl chain, R', R'', and R''' may be either long alkyl chains or smaller alkyl or aryl groups or hydrogen and X represents an anion.

The alkaline source can be added to the composition in the form of solid. For example, alkali metal hydroxides are commercially available as a solid in the form of prilled solids or beads having a mix of particle sizes ranging from 25 about 12-100 U.S. mesh. For example, an alkali metal hydroxide may be added to the solid detergent composition in a variety of solid forms, including for example in the form of solid beads. Alkali metal hydroxides are commercially available.

The pressed solid detergent blocks of the present invention contain one, two, or more alkaline compounds in the second solid, each compound may be a solid by itself. Alternatively, the two or more alkaline compounds are one solid of their mixtures. In some aspects, two alkaline components are employed in the pressed solid detergent. In other aspects, a single alkaline is employed in the pressed solid detergent.

The pressed solid detergent blocks can include a sufficient amount of the alkaline source to provide the use composition with a pH of at least about 8. The alkaline source is preferably in an amount to enhance the cleaning of a substrate and improve soil removal performance of the composition. In general, it is expected that the concentrate will include the alkaline source in an amount of at least about 5 wt-%, at least about 10 wt-%, or at least about 15 wt-%. The pressed solid detergent composition can include between about 10 wt-% and about 95 wt-%, preferably between about 15 wt-% and about 70 wt-%, between about 20 wt-% and about 60 wt-%, and even more preferably between about 70 wt-% and about 95 wt-% of the alkaline source.

In order to provide sufficient room for other components in the solid blocks of the present application, the alkaline source can be provided in the concentrate in an amount of less than about 60 wt-%. In addition, the alkaline source can be provided at a level of less than about 40 wt-%, less than about 30 wt-%, or less than about 20 wt-%.

In some embodiments, the pressed solid detergent block produced from the disclosed composition, process, or method has about 50 wt % to about 95 wt %, 75 wt % to about 95 wt %, about 95 wt %, about 90 wt %, about 85 wt %, about 80 wt %, about 75 wt %, about 70 wt %, about 65 wt %, or about 50 wt % of the alkaline source.

In some embodiments, this second solid of the disclosed method, process, or composition contains one or more solid alkaline compounds only. In some other embodiments, the second solid contains about 99 wt-%, 95 wt-%, 80 wt-%, 70 wt-%, 60 wt-%, 50 wt-%, 40 wt-%, 30 wt-%, 20 wt-%, 10 wt-%, from about 90 wt-% to about 99% wt-%, from about 80 wt-% to about 89% wt-%, from about 70 wt-% to about 79% wt-%, from about 60 wt-% to about 69% wt-%, from about 50 wt-% to about 59% wt-%, from about 40 wt-% to about 49% wt-%, from about 30 wt-% to about 39% wt-%, from about 20 wt-% to about 29% wt-%, or from about 10 wt-% to about 19% wt-% of solid alkaline compounds.

In some other embodiments, the second solid of the disclosed method, process, or composition may contain all other ingredients of a solid detergent composition in addition to alkali source, such as enzymes and other functional ingredients.

In some embodiments, the one or more alkaline compounds of the disclosed method, process, or composition are an alkali metal carbonate, alkali metal metasilicate, alkali metal bicarbonate, alkali metal sesquicarbonate, alkali hydroxide, silicate, metasilicate, urea sulfate, amine, amine salt, quaternary ammonia, hydrate thereof, or a mixture of two or more thereof. In some other embodiments, the one or more alkaline compounds of the disclosed composition are an alkali metal carbonate and provides a pH in use solution of at least about 8.5, about 8, about 9, about 10, about 11, or about 12. In yet some other embodiments, the one or more alkaline compounds of the disclosed invention are one or more selected from a group consisting of alkali carbonate, sodium carbonate, alkali bicarbonate, and sodium bicarbonate.

In other embodiments, the second solid of the disclosed method, process, or composition is alkali metal carbonate, alkali metal bicarbonate solid, sodium bicarbonate solid, or a mixture of one or more thereof. In some other embodiments, the second solid of the disclosed invention is a mixture of sodium carbonate, and solid sodium bicarbonate.

In some other embodiments, the first or second solid of the disclosed method, process or composition is independently a powder, flake, particulate, crystalline solid, amorphous solid, or a mixture thereof. In some other embodiments, the first solid of the disclosed method, process, or composition is a mixture of two or more solids, each of which comprises one or more anionic surfactants. In yet some other embodiments, the first solid of the disclosed method, process, or composition is a single solid comprising one or more anionic surfactants.

In some embodiments, the second solid of the disclosed method, process, or composition is a mixture of two or more solids, each of which comprises one or more alkaline compounds or their hydrates. In some other embodiments, the second solid of the disclosed composition is a single solid comprising one or more alkaline compounds or their hydrates.

Dispense Rates of Pressed Solid Detergents

In some embodiments, the pressed solid detergent block produced from the disclosed method, process, composition has a dispense rate of from about 20 to about 120 g/per cycle, when using a spray type dispenser with a 60 second dispense period, and water with a pressure of from about 20 psi to about 50 psi and a temperature of from 90° F. to about 140° F., and the solid block with a dimension and shape designed for the dispenser. A spray type dispenser has a nozzle at the bottom with an air gap to create an effective fan pattern to erode/dissolve chemistry of a solid detergent block. The solution runs by gravity to a funnel at the base and is directed into the use container (sink, tub bottle, etc.). Examples of spray dispensers include the Ecolab APEX family, Ecolab Solitron or WashMax dispensers, Knight Sink Bowl and Power Bowl, and many others commercially available.

In some embodiments, the pressed solid detergent block produced from the disclosed method, process, or composition has a dispense rate of from about 30 to about 75 g/per cycle when using a spray type dispenser with a 60 second dispense period, and water with a pressure of about 20 psi and a temperature of from 90° F. to about 140° F., and the solid block has a dimension and shape designed for the dispenser.

In some embodiments, the pressed solid detergent block produced from the disclosed method, process, or composition has a dispense rate of from about 20 to about 60 g/per cycle when using a spray type dispenser with a 60 second dispense period, water with a pressure of from about 20 psi to about 50 psi and a temperature of about 90° F., the solid block with a dimension and shape designed for the dispenser.

In some embodiments, the pressed solid detergent block produced from the disclosed method, process, or composition has an essentially same dispense rate as an extruded solid block with an essentially similar composition. In other embodiments, the pressed solid detergent block produced from the disclosed method, process, or composition has an essentially same dispense rate as a casted solid block with an essentially similar composition.

In some embodiments, the pressed solid detergent block produced from the disclosed method, process, or composition has a water content of less than about 10 wt-%, 9 wt-%, 8 wt-%, 7 wt-%, 6 wt-%, 5 wt-%, 4 wt-%, 3 wt-%, 2 wt-%, 1 wt-%, 0.7 wt-%, 0.5 wt-%, 0.3 wt-%, 0.1 wt-%, 0.05 wt-%. In some other embodiments, the pressed solid detergent block produced from the disclosed method, process, or composition has a water content of between about 0.1 and about 10 wt-%, between about 0.1 and about 5 wt-%, between about 0.1 and about 3 wt-%, between about 1 and about 8 wt-%, between about 5 and about 10 wt-%, between about 5 and about 15 wt-%, or between about 5 and about 15 wt-%. In an aspect, the dried composition may be in the form of granules. On contrast, cast or extruded solid detergent blocks can have from about 10 to about 40 wt-% water.

As used here, "an essentially same (or equivalent) dispense rate" is referred to a dispense rate that is within about 5-10%, within about 10%, within about 9%, within about 8%, within about 7%, within about 6%, or preferably within about 5%, within about 4%, within about 3%, within about 2%, or within about 1% of the reference dispense rate measured by the same procedure, condition, and equipment. To determine an essentially same or equivalent dispense rate the compared blocks have identical shapes and dimensions.

As used here, "an essentially similar composition" is referred to a composition in which everything else is the same except the addition of a different amount of the first solid, or of which the weight percent of alkaline compounds is within 10% of one for the reference composition. An essentially similar composition may also refer to a detergent composition that include all active detersive and other functional ingredients, but without its water content or with a reduced or full water content. The compared blocks have identical shapes and dimensions.

Additional Functional Ingredients

In some embodiments, the blocks of the disclosed method, process or composition contains additional ingredients. These ingredients can be in solid form and therefore be added to produce the blocks by mixing them with either the first solid, second solid or both. These ingredients can also be in liquid form and can be added to the disclosed composition either by spraying up to either the first solid, second solid or both. The liquid ingredients can also be mixed with the first or second solid by other means during the preparation of those solids as person skilled in the art would understands.

In some embodiments, the alkalinity source and anionic surfactant(s) make up a large amount, or even substantially all of the total weight of the detergent blocks, for example, in embodiments having few or no additional functional ingredients disposed therein. In these embodiments, the component concentrations ranges provided above for the detergent blocks are representative of the ranges of those same components in the detergent blocks. In some other embodiments, additional functional ingredients make up some amount of the total weight of the detergent blocks.

The functional ingredients provide desired properties and functionalities to the detergent composition. For the purpose of this application, the term "functional ingredients" includes an ingredient that when dispersed or dissolved in a use and/or concentrate, such as an aqueous solution, provides a beneficial property in a particular use. Some particular examples of functional ingredients are discussed in more detail below, although the particular materials discussed are given by way of example only, and that a broad variety of other functional ingredients may be used. For example, many of the functional ingredients discussed below relate to materials used in cleaning applications. However, other embodiments may include functional ingredients for use in other applications.

Exemplary additional functional ingredients include for example: builders or water conditioners, including detergent builders; chelants; threshold agents; crystal modifiers; hardening agents; bleaching agents; fillers; defoaming agents; anti-redeposition agents; stabilizing agents; dispersants; enzymes; glass and metal corrosion inhibitors; fragrances and dyes; thickeners; etc. Further description of suitable additional functional ingredients is set forth in U.S. Pat. No. 8,748,364, which is incorporated herein by reference in its entirety.

In some embodiments, the blocks produced from the disclosed method, process, or composition further comprises additional functional ingredient selected from the group consisting of an enzyme, oxidizer, peroxyacid and its initializer, sanitizing agent, defoaming agent, anti-redeposition agent, bleaching agent, solubility modifier, dispersant, threshold agent, crystal modifier, binding agent, rinse aid, polymer, metal protecting agent, stabilizing agent, corrosion inhibitor, sequestrant and/or chelating agent, fragrance and/or dye, rheology modifier or thickener, nonionic surfactant, cationic surfactant, amphoteric surfactant, zwitterionic surfactant, hydrotrope or coupler, and combination thereof.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water-soluble compound having the desired degree of balance between hydrophilic and hydrophobic properties. Useful nonionic surfactants include:

Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-flinctional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include: Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

The alkylphenoxypolyethoxyalkanols of U.S. Pat. No. 2,903,486 issued Sep. 8, 1959 to Brown et al. and represented by the formula

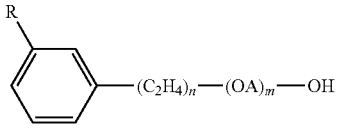

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

Polyhydroxy fatty acid amide surfactants suitable for use in the present compositions include those having the structural formula $R_2CON_{R1}Z$ in which: R1 is H, C hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

A useful class of non-ionic surfactants include the class defined as alkoxylated amines or, most particularly, alcohol alkoxylated/aminated/alkoxylated surfactants. These nonionic surfactants may be at least in part represented by the general formulae: $R^{20}$—$(PO)_sN$—$(EO)_tH$, $R^{20}$—$(PO)_sN$—$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_V$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

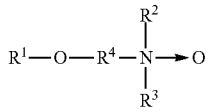

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

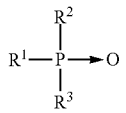

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methyl ethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

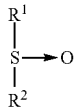

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 ($R-(EO)_5(PO)_4$) and Dehypon LS-36 ($R-(EO)_3(PO)_6$); and capped alcohol alkoxylates, such as Plurafac LF221 and Tegoten EC11; mixtures thereof, or the like.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

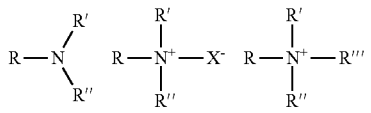

in which, R represents an alkyl chain, R', R", and R"' may be either alkyl chains or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

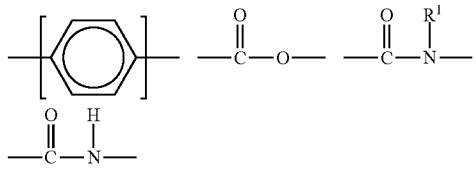

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

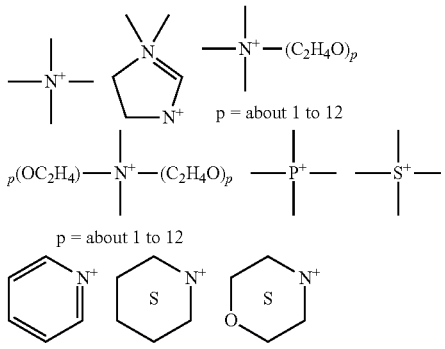

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

(MONO)ACETATE

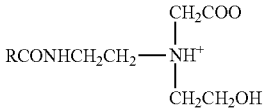

Neutral pH Zwitternion (DI)PROPIONATE

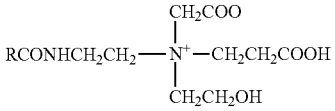

AMPHOTERIC SULFONATE

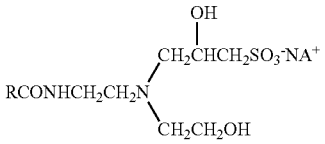

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R=C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+$($CH_2$—$CH_2$—$CO_2Na)_2$—$CH_2$—$CH_2$—OH or $C_{12}$-alkyl-C(O)—N(H)—$CH_2$—$CH_2$—$N^+(CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

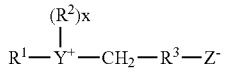

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

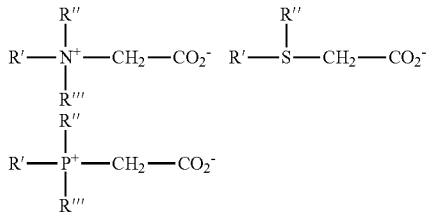

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acyl amidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a C hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety.

Defoaming Agent

A defoaming agent for reducing the stability of foam may also be included in the warewashing composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Concentrate and Use Solutions for Methods of Use

The solid detergent compositions as provided in a block are concentrate compositions. In general, a concentrate refers to a composition that is intended to be diluted with water to provide a use solution that contacts an object to provide the desired cleaning, rinsing, or the like.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. A concentrate may be diluted at a ratio of between about 1:10 and about 1:10,000 concentrate to water. Particularly, a concentrate is diluted at a ratio of between about 1:100 and about 1:5,000 concentrate to water. More particularly, a concentrate may be diluted at a ratio of between about 1:250 and about 1:2,000 concentrate to water.

The dispense rate of a block is an important factor to generate its use solution. The dispense rate and the dilution factor together determine how much water should be used in each dispense cycle and what type of dispense equipment should be used. Conversely, given a dispense equipment, a solid block with suitable dispense rate should deliver a use solution that are suitable for the application.

In an aspect of the invention, a use solution of the solid detergent blocks has between about 10 ppm to about 6000 ppm alkalinity source. In a preferred aspect of the invention, a use solution of the solid detergent block has between about 500 ppm to about 4000 ppm alkalinity source. In a still further preferred aspect of the invention, a use solution of the solid detergent composition has between 2500 ppm to about 3500 ppm alkalinity source. In addition, without being limited according to the invention, all ranges recited are inclusive of the numbers defining the range and include each integer within the defined range.

In an aspect of the invention, the solid detergent block preferably provides efficacious cleaning at low use dilutions, e.g., require less volume to clean effectively. In an aspect, the solid detergent block may be diluted in water prior to use at dilutions ranging from about 1/16 oz./gal. to about 2 oz./gal. or more. A solid detergent block that requires less volume to achieve the same or better cleaning efficacy and provides hardness scale control and/or other benefits at low use dilutions is desirable.

In some aspects, the solid detergent blocks are contacted by a diluent, such as water to generate a concentrate and/or use solution for the various applications of use. According to aspects of the solid detergent compositions, the block remains stable during use where water or other diluent contacts the solid (e.g. water is sprayed at a portion of the solid to cause reaction upon dilution of a portion of the solid). In an aspect, the solid block remains stable for several hours to several weeks, from about 1 day to about 2 weeks, or from about a month to about two years before its use in a dispenser. Beneficially, the solid composition delivers a desired amount of active cleaning agent during dispensing to obtain the desired bleaching, antimicrobial and/or sanitizing effect, without causing the reaction of the remainder of the reactive components in the solid formulation as a result of the pressing process and the nature of composition.

In some aspects, the solid composition according to the present invention provides a use solution having a pH of at least about 8. When the use solution has a pH of between about 8 and about 10, it can be considered mildly alkaline, and when the pH is greater than about 12, the use solution can be considered caustic. In general, it is desirable to provide the use solution as a mildly alkaline cleaning composition because it is considered to be safer than the caustic based use compositions. In some embodiments, a use solution of a solid block produced from the disclosed method, process, or composition here has a pH of above 8, above 9, above 10, above 11, or preferably from about 9 to about 11.5.

In some aspects, the present invention provides methods for removing soils from a surface, e.g., a hard surface, and/or bleaching a surface. In some embodiments, the method comprises contacting a use solution of the detergent blocks with a surface, and removing the composition from the surface after an amount of time sufficient to facilitate soil removal and/or bleaching. The contacting step can last for any suitable time. In some embodiments, the contacting step lasts for at least 10 seconds, 20 seconds, 30 seconds, 40 seconds, 50 seconds, 1 minute, 10 minutes, 30 minutes, 1 hour, 2 hours, 4 hours, 8 hours, 16 hours, 1 day, 3 days, 1 week, or longer. The detergent composition can contact the surface (or target for soil removal and/or bleaching) in any suitable manner. In some embodiments, the detergent composition is applied by means of a spray, a foam, soaking or the like.

The methods can be used to achieve any suitable removal of soil (e.g. cleaning), sanitizing, disinfecting, bleaching and/or reduction of the microbial population in and/or on the surface or target. In some embodiments, the methods can be used to reduce the microbial population by at least one log 10. In other embodiments, the present methods can be used to reduce the microbial population in and/or on the target or the treated target composition by at least two log 10. In still other embodiments, the present methods can be used to reduce the microbial population in and/or on the target or the treated target composition by at least three log 10.

In some embodiments, the method further comprises rinsing the surface. In some embodiments, the method further comprises a mechanical application of force, agitation and/or pressure to assist in removing the soils and/or bleaching the surface.

The methods of the present invention can be used to remove a variety of soils from a variety of surfaces and/or bleaching a variety of surfaces. For example, surfaces suitable for cleaning using the methods of the present invention include, but are not limited to, walls, floors, ware, dishes, flatware, pots and pans, heat exchange coils, ovens, fryers, smoke houses, sewer drain lines, and the like.

In some embodiments, the methods of the present invention are followed by only a rinse step. In other embodiments, the methods of the present invention are followed by a conventional CIP method suitable for the surface to be cleaned. In still yet other embodiments, the methods of the present invention are followed by a CIP method such as those described in U.S. Pat. Nos. 8,398,781 and 8,114,222 entitled "Methods for Cleaning Industrial Equipment with Pre-treatment," both of which are hereby incorporated by reference in their entirety.

Methods of Use

In another aspect, disclosed here is a method of cleaning, sanitizing and/or bleaching comprising generating a use solution of the pressed solid detergent block produced from the disclosed method, process, or composition that comprise solid anionic surfactant(s) and a solid alkaline source, and contacting a surface or object in need of cleaning and sanitizing with the use solution. Beneficially according to the present invention the dispense rate of the pressed solid detergent composition is capable of being controlled or adjusted to a particular rate of dispensing into an application of use based upon the concentration of the anionic surfactant employed therein.

In an aspect of the invention, a method of adjusting dispense rate of an existing solid detergent composition comprises mixing a first solid comprising an anionic surfactant and a second solid comprising an alkaline source to obtain a solid mixture, and pressing the solid mixture to form a solid block, wherein the alkaline source comprises one or more alkaline compounds. In an aspect the dispense rate is modified by the inclusion of anionic surfactant such that the dispense rate is from about 20 to about 120 g/per cycle, wherein the dispense rate is measured by an spray type dispenser using a 60 second dispense period, and water with a pressure of from about 20 psi to about 50 psi and a temperature of from 90° F. to about 140° F., and the solid block with a dimension and shape designed for the dispenser.

In a further aspect, the adjustment of the dispensing rate of a solid detergent is modified by the inclusion of anionic surfactant such that the dispense rate is from about 30 to about 75 g/per cycle, wherein the dispense rate is measured by an spray type dispenser using a 60 second dispense period, and water with a pressure of about 20 psi and a temperature of from 90° F. to about 140° F., and the solid block with a dimension and shape designed for the dispenser. In a still further aspect, the adjustment of the dispensing rate of a solid detergent is modified by the inclusion of anionic surfactant such that the dispense rate is from about 20 to about 60 g/per cycle, wherein the dispense rate is measured by an spray type of dispenser using a 60 second dispense period, and water with a pressure of from about 20 psi to about 50 psi and a temperature of about 90° F., and the solid block with a dimension and shape designed for the dispenser.

Beneficially, according to the embodiments of the invention the dispense rate of the pressed solid is modified to have the essentially same dispense rate, which is within about 5% or less, or 4% or less, or 3% or less, or 2% or less, or 1% or less of the dispense rate of the target solid composition (e.g. an extruded solid block or a cast solid block) with an essentially similar composition, dimension and shape, measured by the same procedure, condition, and equipment.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments, in addition to those shown and described herein, will be apparent to those skilled in the art from the foregoing description. Such modifications are also intended to fall within the scope of the appended claims.

The following materials are used in the Examples:

Bio-terge® AS-90-90% active $C_{14}$-$C_{16}$ alpha olefin sulfonate (AOS);

Ufaryl DL90C—90% $C_{10}$-$C_{13}$ active linear alkylbenzene sulfonate (LAS), drum dried powder;

Belclene 200-50% active polymaleic acid;

Acusol™ 445N—45% active polyacrylic acid

Acusol™ 445ND—% dried polyacrylic acid

Acusol™ 820—a Hydrophobically modified Alkali Soluble acrylic polymer Emulsion

Acusol™ 929-46% active polyacrylic

Dense Ash—Sodium Carbonate;

Light Ash—Sodium Carbonate;

Sodium Bicarbonate, granular;

PEG 8000—Polyethylene glycol with an average molecular weight of 8,000;

Powder Bicarb—Sodium bicarbonate, in powder;

CMC-7LT—carboxymethylcellulose;

LAE 24-7—Linear alcohol ethoxylate (7 moles EO);

PBTC—Phosphonebutane tricarboxylic acid;

STPP—sodium tripolyphosphate;

HEDP—1-hydroxy ethylidene-1, 1-diphosphonic acid;

Example 1

Various compounds were used as an additional ingredient in an existing pressed solid detergent composition to evaluate their respective effect on the block's dispense rate. The control solid detergent composition formulation is an extruded block as listed in Table 3 (below) under "no anionic" column. The modified solid detergent block compositions were made with one of the compounds listed in Table 1 as an additional component or with its absence. Each evaluated compound was added to the original detergent mix to make a modified block mix and then pressed into a pressed solid detergent block in laboratory. The liquid components of the composition, e.g., liquid premix and LAE-24-7 were sprayed on the solid alkaline source(s) before mixing the evaluated compound and the original composition.

The solid detergent block compositions used in this example were made in a laboratory. Each block is about 500 grams and have a diameter of 3 inches and surface area of about 7.07 square inches. About 5% wt-% of each compound listed in Table 1 was used to make a modified block. In Table 1, "Low water", "Med water", and "Light water" means 4, 6, and 8 wt-% water, respectively. Since the laboratory produced blocks are much smaller than blocks produced in plants, the dispense rates measured were not meant to be compared with those for plant produced blocks.

The dispense rates for the modified solid detergent compositions are listed in Table 1 and the cumulative masses dispensed for each modified composition are plotted against number of cycles in FIG. 1. For the dispense rates listed in Table 1 and data points in FIG. 1, a 120° F. water with 20 psi was used in a 90 second dispense period. The data points were collected after about 90 wt-% of the block was consumed and were not used during the line fitting procedure, because of the surface of the block may become irregular or smaller. The dispense rate is depicted as the slope of the fitted line and has a unit of g/cycle.

TABLE 1

List of Compounds in a Lab Pressed Block and Their Effect on Dispense Rate of Presoak Solid Detergent Composition; each composition is labeled in FIG. 1 (A-U) showing the dispense rate of each in g/cycle.

| | Y a + bx | | |
|---|---|---|---|
| Additive | a | bx | R^2 |
| 1% LAS | 0 | 9.3491 | 0.9383 |
| 2.5% LAS | 0 | 6.6557 | 0.9889 |
| 5% LAS | 0 | 5.479 | 0.9938 |
| 445ND | 0 | 8.6842 | 0.9617 |
| Acusol 820 | 0 | 6.4113 | 0.883 |
| Citrate | 0 | 15.051 | 0.9943 |
| CMC-7LT | 0 | 5.6355 | 0.9943 |
| TARGET | 0 | 7.1279 | 0.9747 |
| Gluconate | 0 | 8.9468 | 0.9636 |
| Glycerin | 0 | 9.2803 | 0.9223 |
| Hi water | 0 | 10.462 | 0.9955 |
| Light Ash | 0 | 10.21 | 0.9601 |
| low water | 0 | 9.6012 | 0.9877 |
| med water | 0 | 10.009 | 0.5845 |
| NaOH | 0 | 10.793 | 0.9932 |
| no 24-7 | 0 | 15.208 | 0.8323 |
| No Bicarb | 0 | 8.5877 | 0.9392 |
| No binder | 0 | 29.151 | 0.8636 |
| PED 8000 | 0 | 7.9 | 0.9892 |
| Pwdr Bicarb | 0 | 11.406 | 0.8612 |

Example 2

Various compounds were also used as an additional ingredient in the pressed solid detergent block compositions made in a pilot plant to evaluate their respective effect on the detergent composition's dispense rate. The control formulation was made with the compounds and amounts listed in Table 3 under "no anionic" column. Each evaluated compound was added to the original Detergent mix to make a modified block mixture and then the mixture was pressed into a block. The liquid components of the composition, i.e., liquid premix and LAE-24-7 were sprayed on the solid alkaline source(s)

The solid detergent blocks used in this example are about 1816 grams or 4 pounds and have a surface area of about 19.9 square inches, a dimension and shape designed for a spray or flood style dispenser where in a 60 second dispense period (or other identified time interval) an appropriate amount of use solution is produced as described herein.

Figure 2:
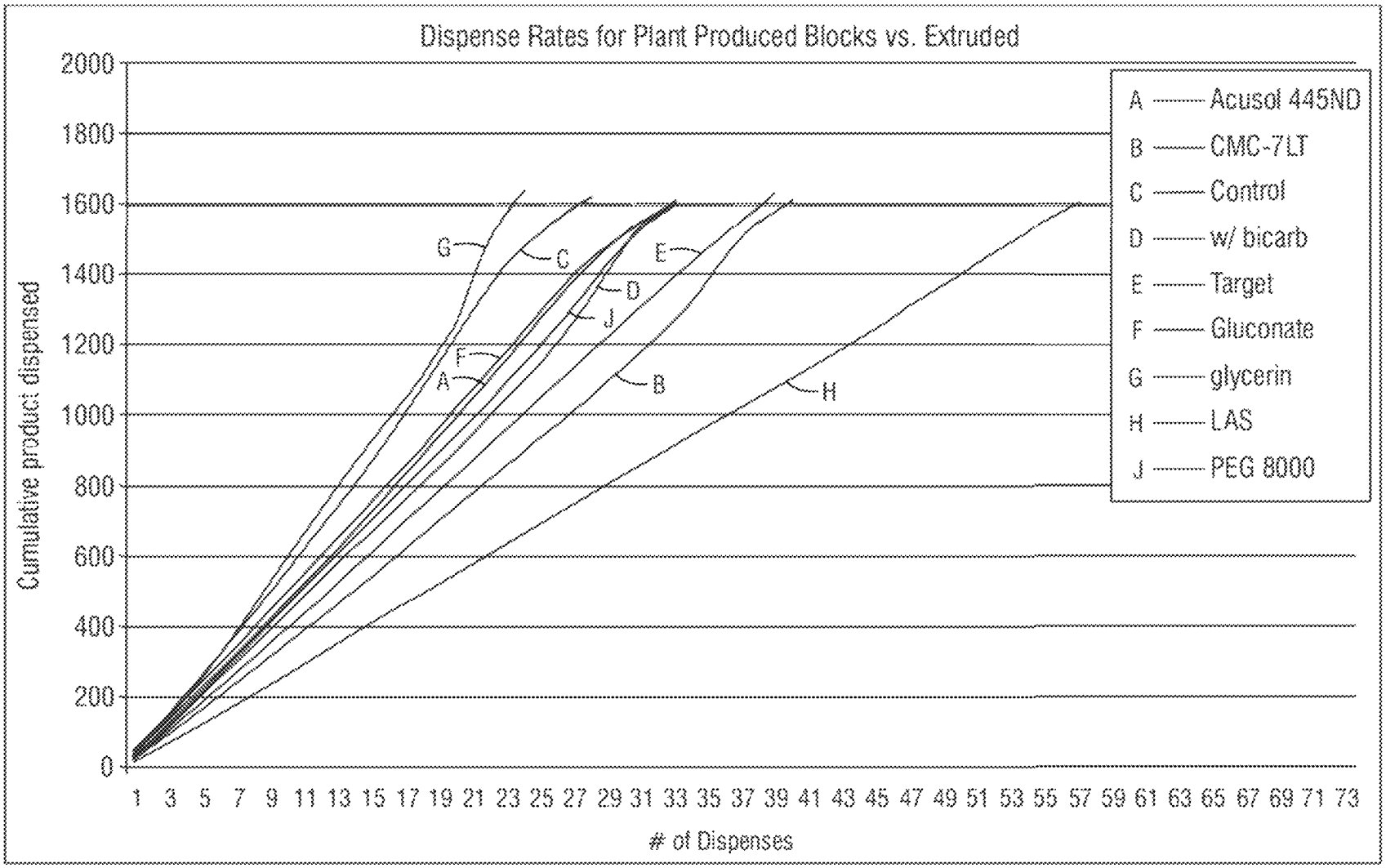
FIG. 2 shows the dispense rate comparing solid detergent block compositions with the addition of one more solid components according to an embodiment disclosed herein.

The dispense rates for these modified solid detergent compositions are listed in Table 2 and plotted in FIG. 2. The Control shown in FIG. 2 is the "No Additive" formulation of Table 2. For the dispense rates listed in Table 2 and data points in FIG. 2, a 110° F. water with 20 psi was used in a 60 second dispense period. The data shows that 5% LAS reduces the dispense rate to a value less than the control target rate block, while other materials reduce the dispense rate to a lesser degree, with the exception of glycerin that increased the dispense rate in comparison to the extruded block control formulation.

TABLE 2

List of Compounds in a Pilot Plant Pressed Solid Detergent Block and Their Effect on Dispense Rate of Presoak Solid Detergent Block; each composition is labeled in FIG. 2 (A-J) showing the dispense rate of each in g/cycle.

| Additive | Dispense rate (g/60 sec) |
|---|---|
| 5% LAS | 27.07 |
| Target rate | 36.51 |

TABLE 2-continued

List of Compounds in a Pilot Plant Pressed Solid Detergent Block and Their Effect on Dispense Rate of Presoak Solid Detergent Block; each composition is labeled in FIG. 2 (A-J) showing the dispense rate of each in g/cycle.

| Additive | Dispense rate (g/60 sec) |
|---|---|
| 5% CMC | 38.81 |
| 5% dried polyacrylate | 43.02 |
| 5% PEG8000 | 45.97 |
| 5% Bicarbonate | 46.82 |
| 5% Gluconate | 50.6 |
| No additive | 51.81 |
| 5% glycerin | 62.7 |

Example 3

The effect of anionic surfactant concentration on dispense rate in a pressed solid detergent block composition was also evaluated and compared to an extruded detergent solid block composition. The composition for each tested solid block is listed in Table 3. The dispense test results are presented in FIG. 3. For the data points in FIG. 3, a 110° F. water with 20 psi was used in a 60 second dispense period. The solid detergent block with 5% anionic surfactant has a dispense rate that matches very well with one of an extruded solid block. This evaluation also shows that the dispense rate of a pressed solid detergent block can be adjusted by changing the concentration or type of anionic surfactants.

TABLE 3

Figure 3:
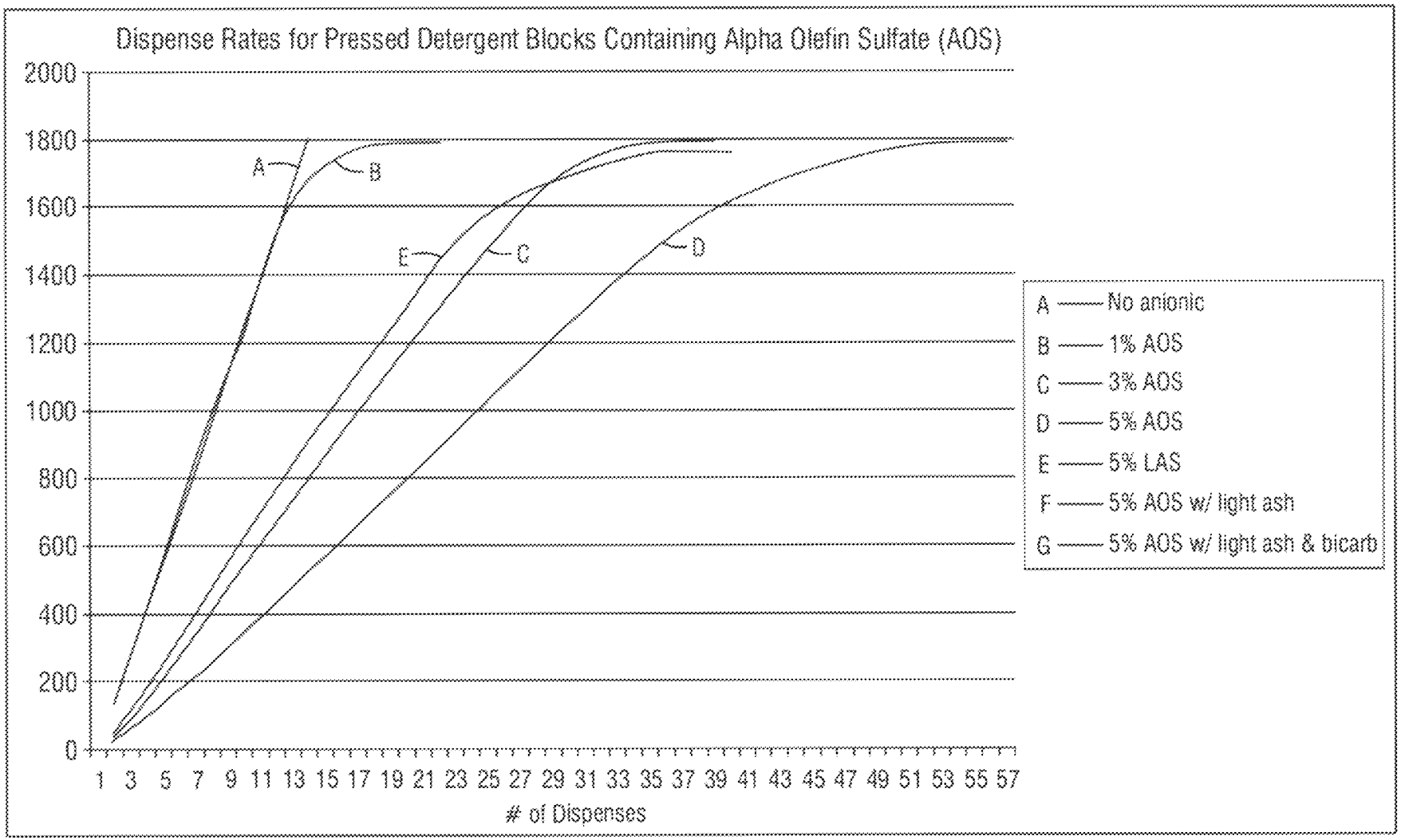
FIG. 3 shows the dispense rates for pressed detergent block compositions containing different amounts and types of solid anionic surfactants and other materials.

Compositions for the Original Solid Detergent Block and Modified Solid Detergent Blocks; each composition is labeled in FIG. 3 (A-G) showing the dispense rate of each in g/cycle.

| Presoak Small Press | No anionic | 5% AOS | 3% AOS | 1% AOS | 5% LAS | 5% AOS w/ ash | 5% AOS w/ ash | 5% AOS w/ STPP |
|---|---|---|---|---|---|---|---|---|
| Sodium carbonate | 87.11<br>0<br>0 | 82.11<br>0<br>0 | 84.1<br>0<br>0 | 86.11<br>0<br>0 | 82.1<br>0<br>0 | 57.11<br>0<br>25 | 42.11<br>0<br>20 | 74.61<br>0<br>0 |
| Sodium bicarbonate | 0 | 0 | 0 | 0 | 0 | 0 | 20 | 0 |
| STPP | 0 | 0 | 0 | 0 | 0 | 0 | 0 | 7.5 |
| Alpha olefin sulfonate | 0 | 5 | 3 | 1 | 0 | 5 | 5 | 5 |
| Linear alkylbenzene sulfonate | 0 | 0 | 0 | 0 | 5 | 0 | 0 | 0 |
| Enzyme | 1.3 | 1.3 | 1.3 | 1.3 | 1.3 | 1.3 | 1.3 | 1.3 |
| Water | 3.45 | 3.45 | 3.45 | 3.45 | 3.45 | 3.45 | 3.45 | 3.45 |
| Water conditioning blend (polymers and NaOH, 50%) | 5.8 | 5.8 | 5.8 | 5.8 | 5.8 | 5.8 | 5.8 | 5.8 |
| Other Surfactant | 0.342<br>2 | 0.342<br>2 | 0.342<br>2 | .342<br>2 | 0.342<br>2 | 0.342<br>2 | .342<br>2 | .342<br>2 |
| Total | 100 | 100 | 100 | 100 | 100 | 100 | 100 | 100 |

Example 4

Figure 4:
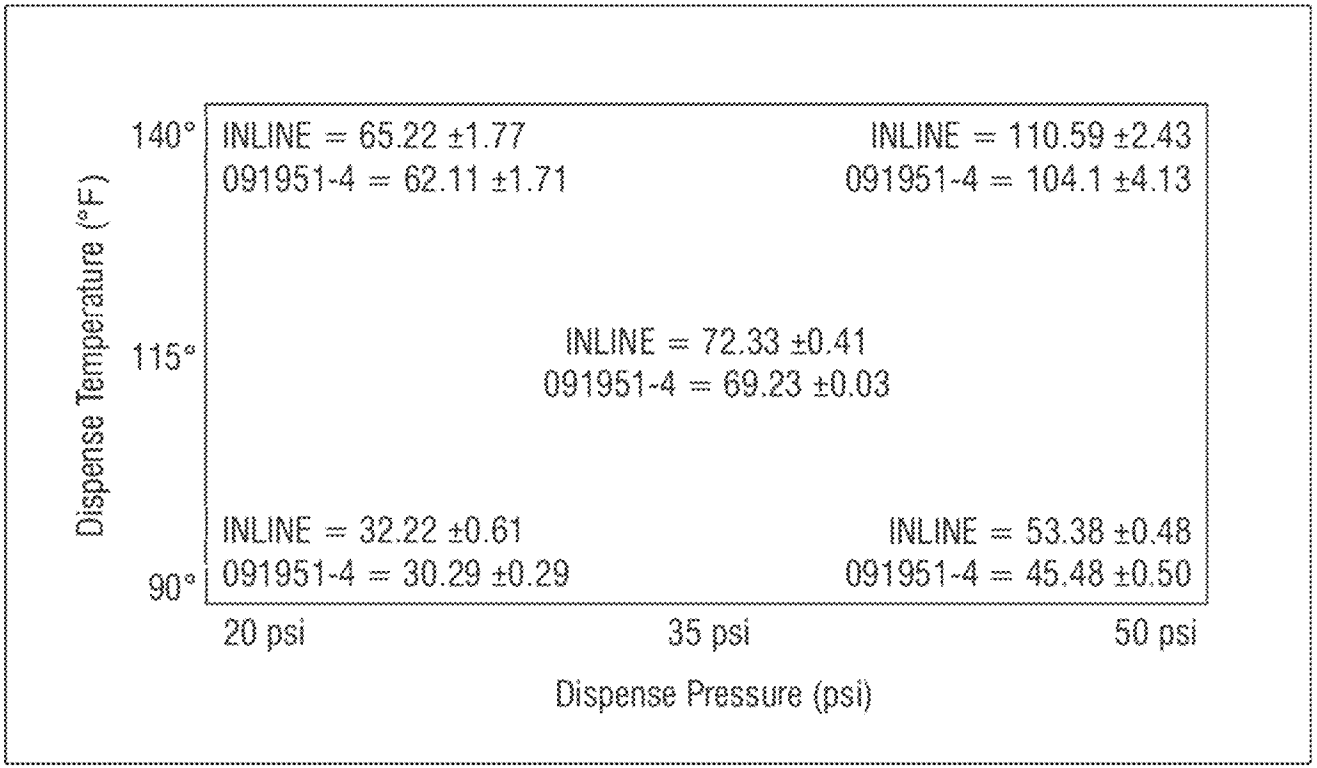
FIG. 4 shows a comparison of dispense rates for an extruded solid block composition and a pressed solid block composition using water of different temperatures and pressures.

The dispense rates of a pressed solid detergent block was compared to an extruded block under different water temperatures and pressures. The composition for the pressed solid detergent block is listed in Table 3 under "no anionic" column. The extruded block has a similar composition, but made in an extrusion process. The results are presented in FIG. 4. Data in this Figure shows that the pressed solid block produced from the composition matches well in term of dispense rate with an extruded block over a wide range of dispensing conditions, demonstrating therefore the formulation can replace an extruded block for cleaning and sanitizing purposes. Beneficially with the equivalent or essentially the same dispense rate, a pressed solid block can be manufactured more economically and safely due to the manufacture process for a pressed solid block not requiring the heating of components of a detergent composition. A pressed solid block therefore can accommodate more diverse ingredients and be used in more applications while modifying the dispense rates thereof based on the concentration and/or type of anionic surfactants in the composition.

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. A method of adjusting dispense rate of a pressed solid detergent composition comprising:

providing a dispenser configured for an existing solid detergent composition that is extruded or casted;

modifying a concentration of a solid anionic surfactant to adjust the dispense rate of a pressed solid detergent composition comprising mixing a first solid comprising from about 1 wt-% to about 5 wt-% of the solid anionic surfactant based on the weight of the pressed solid detergent composition, and a second solid comprising from about 80 wt-% to about 95 wt-% of an alkaline source based on the weight of the pressed solid detergent composition, to obtain a solid mixture; and pressing the solid mixture to form the pressed solid detergent composition, wherein the pressed solid detergent composition is free of an oxidizer and free of a peroxyacid and its initializer;

wherein the solid anionic surfactant comprises an alpha olefin sulfonate or alkylbenzene sulfonate;

wherein the modifying of the concentration of the solid anionic surfactant decreases the dispense rate of the pressed solid detergent composition to provide an essentially same dispense rate as the existing solid detergent composition so to not require manipulation and/or modification of a setting to the dispenser;

wherein the alkaline source comprises an alkali metal carbonate, alkali metal bicarbonate, alkali hydroxide, or a mixture thereof; and wherein the existing solid detergent composition has an essentially similar composition, dimension and shape as the second solid, and wherein the dispense rate of the existing solid detergent composition and the pressed solid detergent composition are measured by the same procedure, conditions, and equipment.

2. The method of claim 1, wherein the pressed solid detergent composition comprises from about 3.5 wt-% to about 4.5 wt-% of the solid anionic surfactant.

3. The method of claim 1, wherein the pressed solid detergent composition comprises from about 85 wt-% to about 95 wt-% of the alkaline source.

4. The method of claim 1, wherein the pressed solid detergent composition further comprises a solid polyethylene glycol, wherein the pressed solid detergent composition has about 0.1 wt-% to about 10 wt-% of the polyethylene glycol and the polyethylene glycol has an average molecular weight of from about 6,000 to about 10,000.

5. The method of claim 1, wherein the anionic surfactant further comprises alkylsulfonate, sulfated alcohol ethoxylate, sulfated alkylphenol, alkylsulfate, sulfosuccinate, alkylether sulfate, alkylphosphate ester, alkylcarboxylate, polyalkoxycarboxylate, alcohol ethoxylate carboxylate, nonylphenol ethoxylate carboxylate, or a mixture of two or more thereof.

6. The method of claim 1, wherein the anionic surfactant further comprises fatty alcohol sulfate, alkylsulfate, sulfosuccinate, sulfated alkylphenol, alkylether sulfate, or a mixture of two or more thereof.

7. The method of claim 1, wherein the anionic surfactant comprises the alpha olefin sulfonate and the alkylbenzene sulfonate.

8. The method of claim 1, wherein the alkaline source further comprises one or more alkaline compounds comprising an alkali metal metasilicate, alkali metal sesquicarbonate, metasilicate, urea sulfate, quaternary amine, amine salt, quaternary ammonia, hydrate thereof, or a mixture of two or more thereof, and provides a pH in use solution of at least about 8.5.

9. The method of claim 1, wherein the first solid and/or the second solid form is independently a powder, flake, particulate, crystalline solid, amorphous solid, or a mixture thereof.

10. The method of claim 1, wherein the dispense rate of the pressed solid detergent composition is from about 20 g/cycle to about 120 g/cycle measured using a 60 second or 90 second dispense period.

11. The method of claim 1, wherein the pressed solid detergent composition has a water content of from about 0.1 wt-% to about 10 wt-%.

12. The method of claim 1, wherein the second solid or first solid further comprises additional functional ingredients selected from the group consisting of an enzyme, chelant, threshold agent, crystal modifier; sanitizing agent, defoaming agent, anti-redeposition agent, solubility modifier, dispersant, rinse aid, polymer, metal protecting agent, stabilizing agent, corrosion inhibitor, sequestrant, fragrance dye, rheology modifier, thickener, nonionic surfactant, cationic surfactant, zwitterionic surfactant, hydrotrope, and combination thereof.

* * * * *